US005957306A

United States Patent [19]

Hoffman

[11] Patent Number: 5,957,306

[45] Date of Patent: Sep. 28, 1999

[54] AIR DECELERATOR FOR PNEUMATIC SORTING SYSTEM

[75] Inventor: Philip L. Hoffman, Medford, Oreg.

[73] Assignee: SRC Vision, Inc., Medford, Oreg.

[21] Appl. No.: 08/877,925

[22] Filed: Jun. 18, 1997

[51] Int. Cl.[6] ..... B07C 5/00

[52] U.S. Cl. ..... 209/587; 209/639; 209/939

[58] Field of Search ..... 209/576, 577, 209/587, 639, 644, 939

[56] References Cited

U.S. PATENT DOCUMENTS

| | | | |
|---|---|---|---|
| 1,655,574 | 1/1928 | Stebbins | 209/154 |
| 1,655,575 | 1/1928 | Stebbins | 209/154 |
| 2,105,589 | 1/1938 | Eades | 226/109 |
| 2,966,264 | 12/1960 | Cox | 209/111 |
| 3,097,161 | 7/1963 | Dudyak | 209/12 |
| 3,097,744 | 7/1963 | Hutter et al. | 209/639 |
| 3,179,247 | 4/1965 | Hutter et al. | 209/639 |
| 3,384,233 | 5/1968 | Bolles | 209/639 |
| 3,405,820 | 10/1968 | Mori | 414/291 |
| 3,757,946 | 9/1973 | Berkowitz et al. | 209/120 |
| 3,908,720 | 9/1975 | Garnett | 141/93 |
| 3,955,679 | 5/1976 | Gebauer | 209/115 |
| 4,082,189 | 4/1978 | Cordes | 209/73 |
| 4,095,625 | 6/1978 | Marpe | 141/93 |
| 4,191,294 | 3/1980 | McGrath, Jr. et al. | 209/135 |
| 4,252,493 | 2/1981 | Ilse | 414/573 |
| 4,303,502 | 12/1981 | Lacher | 209/3 |
| 4,314,645 | 2/1982 | Perkins, III et al. | 209/638 |
| 4,889,241 | 12/1989 | Cogan et al. | 209/639 X |
| 4,969,494 | 11/1990 | Chefson | 141/93 |
| 5,048,674 | 9/1991 | Wilbur et al. | 209/639 X |
| 5,116,486 | 5/1992 | Pederson | 209/12 |
| 5,297,667 | 3/1994 | Hoffman et al. | 198/493 |
| 5,318,173 | 6/1994 | Datari | 209/580 |
| 5,339,964 | 8/1994 | Gray et al. | 209/587 |
| 5,482,166 | 1/1996 | Brown | 209/580 |

FOREIGN PATENT DOCUMENTS

| | | | |
|---|---|---|---|
| 0186259 | 7/1986 | European Pat. Off. | B07C 5/342 |
| 276631 | 3/1990 | Germany | B07C 5/36 |

*Primary Examiner*—David H. Bollinger
*Attorney, Agent, or Firm*—Stoel Rives LLP

[57] ABSTRACT

An air decelerator for an inspection and sorting system employing pneumatic ejectors, comprising an air plenum adapted to generally cause a stream of air to flow in a direction opposing acceptable articles moving in a trajectory, and thereby decelerate the velocity of the articles to reduce the impact of the articles when they come into contact with the receiving surface to minimize damage to the articles caused by the impact.

31 Claims, 3 Drawing Sheets

AIR DECELERATOR FOR PNEUMATIC SORTING SYSTEM

TECHNICAL FIELD

This invention relates to pneumatic sorting systems and in particular to air decelerator units for decelerating the velocity of articles after sorting by pneumatic ejectors, and thereby reduce damage, breakage, and bruising of the articles by cushioning their impact upon contact with a receiving surface.

BACKGROUND OF THE INVENTION

Pneumatic sorting systems are employed in a variety of applications, including automated optical inspection and sorting equipment. Such pneumatic sorting systems for automated optical inspection are described in U.S. Pat. No. 5,318,173 of Datari for a "Hole Sorting System and Method" that is assigned to the assignee of this application.

FIG. 1 shows a prior art automatic inspection and sorting system 10 that is capable of inspecting and sorting, for example, raw or processed fruits or vegetables, such as apples, pears, potato chips, wood chips, recycled plastics, and other similar articles.

In operation, conveyor belt 12 carries articles 14 in a direction 16 through an inspection area 18 of a video camera 20. Video camera 20 delivers to a video signal characteristic of articles 14. Video signal processor 22 is programmed to identify particular characteristics of articles 14 such as, for example, color, shape, size, or the presence of defects. Articles 14 that include defect 24 can now be separated from articles 14 that do not include a defect.

After articles 14 pass through inspection area 18, they are propelled along a trajectory 26 toward an acceptance conveyor belt 28 that turns acceptable articles to subsequent processing station (not shown). Whenever video signal processor 22 determines from the video signal that an article 14 includes a defect 24, an ejection activation signal is delivered to a suitable one of multiple air ejection modules 30. In response to the ejection activation signal, ejection module 30 generates a blast of air 32 that deflects defective article 24 from trajectory 26 in a trajectory 27 toward a reject chute 34. Typically, articles 24 are deflected into reject chute 34 where they are funneled toward a reject conveyor belt 36 for removal. Reject chute 34 is intended to reduce spillage of defective articles.

A problem with prior art system 10 is that as video detection and processing technology improves, belt speeds of a sorting system such as shown in FIG. 1 have increased substantially. The sophistication of such sorters has significantly improved the throughput capacity and thus the performance efficiency of these state-of-the-art sorting systems provide accurate sorting of a variety of products according to multiple parameters at very high speeds.

The resulting high velocity of these rapidly conveyed and pneumatically ejected articles is high, and the high speed impact of the fragile articles such as potato chips on chute, conveyor belt, and other receiving surfaces may compromise the integrity of the articles, and undermine their saleability. A damaged article may not fulfill the specifications and standards of purchasers. Some damage, such as bruising and tearing of fruits, vegetables and other edible articles, may accelerate spoilage, thereby decreasing the shelf life of such an item. Indeed, with the improved quality of food products and processing, shelf lives of food items have increased in recent years. To keep pace with such escalating food quality standards, the need to minimize damage to food products is commensurately increased.

Addressing such heightened quality requirements in view of breakage-provoking sorter velocity rates, prior art mechanisms attempt to alleviate damage to articles caused by impact with a receiving surface have been developed. Such attempts were based on increasing the distance between the ejected article and any acceptance chutes, belt, or containers. However, reliance on mere distance alone and the limited product slowdown imposed by the combined forces of gravity and friction have proved insufficient to soften the surface impact to an extent required to reduce damage of fragile articles to an acceptable level, particularly in state-of-the-art inspection and sorting systems. In addition, space constraints in many sorting and processing facilities have limited the available distance that can be placed between ejectors and acceptance chutes or belts. This has compounded the need for a system which can soften the impact of and thereby prevent or minimize damage to an article impinging on a proximal surface. Moreover, as such systems utilize higher velocity rates, mere distance may not provide the deceleration required to prevent damage to the sorted articles. Thus, unfortunately, no prior sorting system has provided a mechanism that, to an acceptable extent, minimizes damage caused to articles by impact with a receiving surface after they have been pneumatically sorted.

SUMMARY OF THE INVENTION

The present invention addresses such and other problems relating to damage pneumatically sorted articles on prior art inspection and sorting systems by employing an air decelerator system wherein an air plenum adapted to an inspection and sorting system projects a stream of air to flow in a direction opposing the sorted articles, thereby decelerating the articles to cushion their impact when they come into contact with a receiving area surface. This air decelerator system is adaptable to a variety of such systems for sorting unacceptable and acceptable articles according to predetermined characteristics, wherein the articles are conveyed past a video scanning camera that sends video data to a video signal processor for actuating selected combinations of multiple ejection modules. The ejection modules of such systems deflect unacceptable articles with an ejection gas toward a first trajectory directed to one or more rejection duties, belts or similar receiving area. Acceptable articles that are not deflected by an ejection gas are permitted to proceed in a second trajectory directed to a second area surface for receiving acceptable articles. A stream of air flowing from the air plenum is channeled in a direction opposing articles in the second trajectory to decelerate the velocity of the articles. Thus decelerating the articles in the second trajectory cushions their impact when the articles come into contact with the second area surface.

Structurally, the air plenum is defined by a housing having outer surfaces enclosing a generally hollow interior, a lower surface of which is oriented in a proximate position above and substantially parallel to the second trajectory. The housing has an open inlet through which a stream of air enters the interior of the housing and an open outlet configured to channel the stream of air flowing out of the housing in a direction along the lower surface of the housing such that the stream of air opposes articles in the second trajectory.

In one embodiment of the present invention, the housing of the air plenum is defined by opposing walls that are radially joined to form a generally arcuate lower outer surface and a generally rounded lower end. The transverse axis of the lower outer surface of a wall faces downwardly toward the second trajectory and preferably extends at least across the width of the second area surface. The lower outer surface of a preferred embodiment is curved inwardly to form a shallow concave surface beneath which the stream of air flows.

The present invention further includes a generally circumferential inlet duct integrally connected with the open outlet such that the stream of air entering the duct flows in a generally downward direction.

The open outlet may be a slot extending across the width of the lower end of the housing which is defined by an upper portion stepped up from a lower portion such that the slot faces substantially downward toward the portion of the second trajectory directly below the slot.

The present invention may further include a baffle plate containing perforations to more evenly disperse air directed toward the open outlet mounted along a transverse axis within the housing.

The stream of air inducted in the open inlet of the air plenum is preferably generated by a blower. The velocity of the stream of air generated may be further controlled by a damper. An exemplary air velocity rate at the outlet slot suitable for sorting potato chips may range between about 2,800 feet/minute and about 4,900 feet/minute. Static pressure in the plenum may be between about 0.50 inch and about 1.5 inch water column (w.c.). To maximize the proportion of articles entrained in the stream of air beneath the lower outer surface of the housing in a direction opposing the articles in the second trajectory, the air plenum is preferably mounted at a slightly declining slope in a position slightly above the trajectory. An angle of between about 25 degrees and about 35 degrees could suitably orient the air plenum from the horizontal plane.

The present invention further includes a method of decelerating the velocity of articles by providing and orienting an air plenum, and adjusting an associated blower and/or damper, as detailed herein, and blowing a stream of air into the open inlet of the housing such that at least a portion of the stream of air is blown in a direction that flows along the lower surface of the housing and thereby opposes the articles in the second trajectory to decelerate the velocity of the articles and thus reduce the impact of the articles when the articles come into contact with the second area surface.

DETAILED DESCRIPTION OF THE INVENTION

Figure 1:
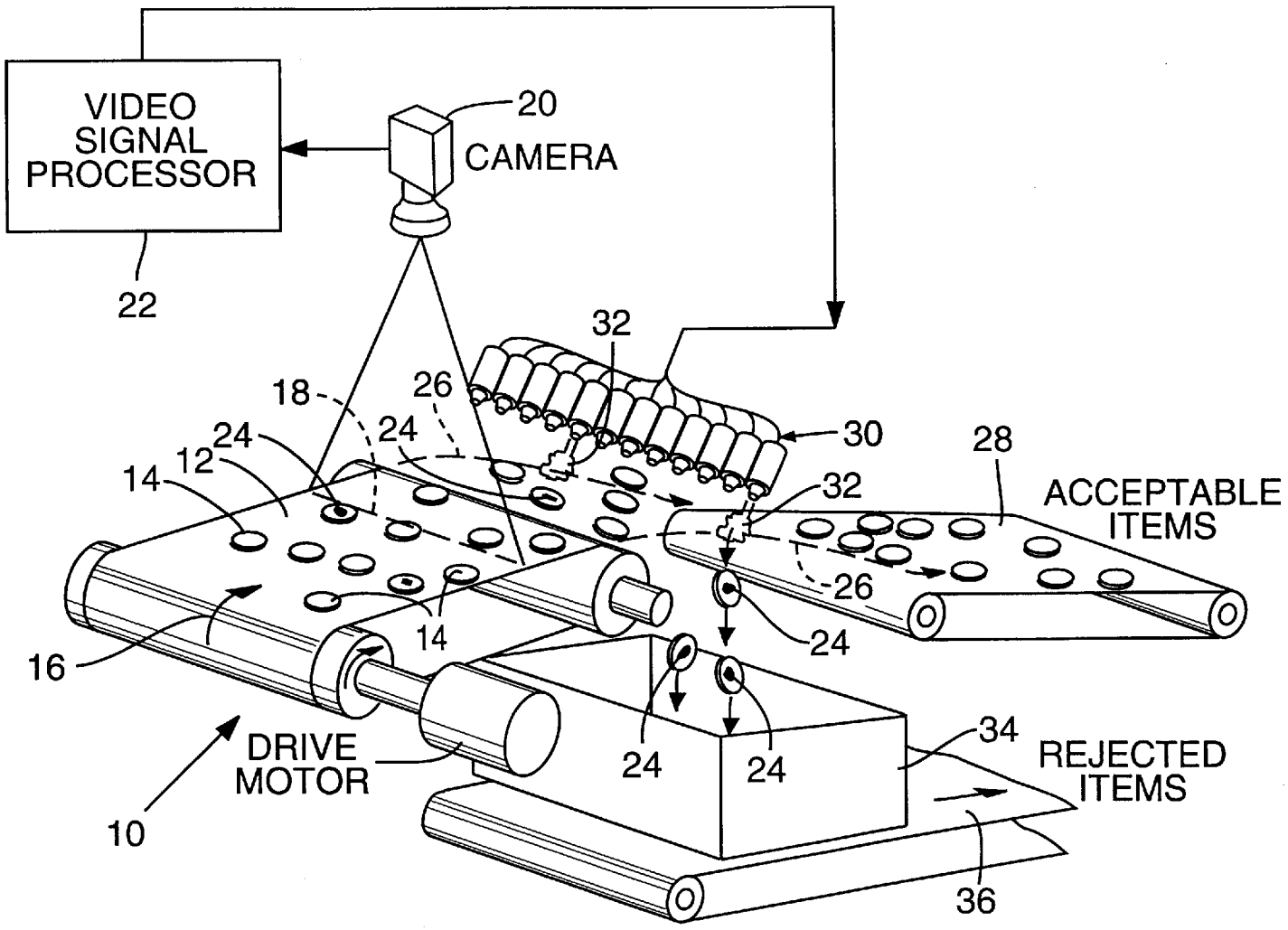
FIG. 1 (Prior Art)
FIG. 1 is a simplified isometric schematic diagram of a prior art inspection and sorting system employing pneumatic ejectors, reject chute and conveyor belt.
Figure 2:
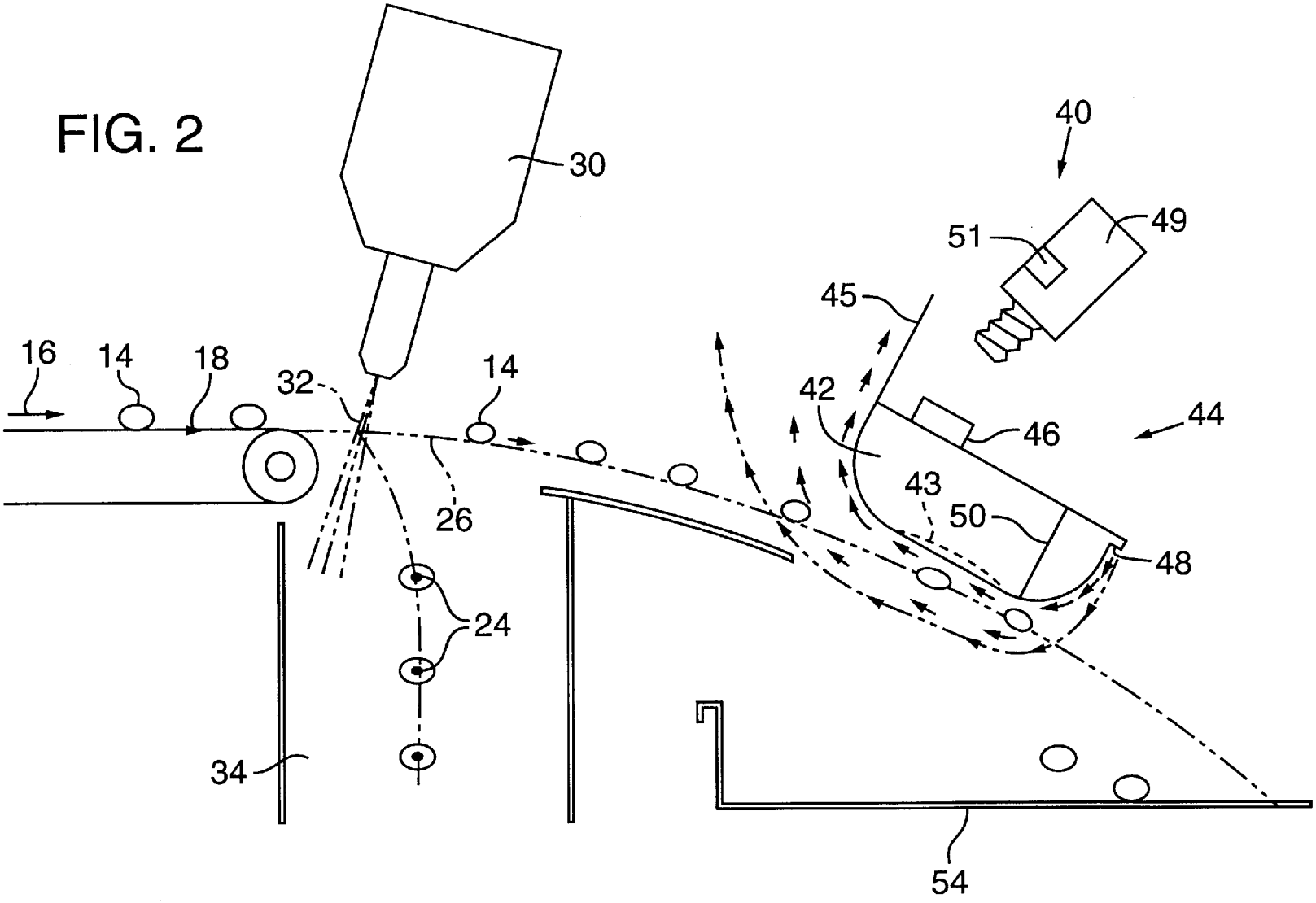
FIG. 2 is a simplified schematic side view of a pneumatic sorting system employing an air decelerator unit according to the present invention shown partly in cross-section to reveal the baffle plate in the air plenum.

FIG. 2 schematically illustrates a pneumatic sorting system employing a preferred embodiment of the air decelerator unit 40 is to cushion the impact of articles 14 in trajectory 26 after articles 14 including defects 24 are deflected by ejection modules 30 in a trajectory 27 toward reject chute 34, as detailed below.

Air decelerator unit 40 includes a housing 42 defining an air plenum 44. Housing 42 is generally rectangular with four opposing sidewalls the lower horizontal edges of which are radially joined to form an arcuate lower outer surface 43 and a rounded lower end wall that form a continuous interface. In the upper portion of housing 42 is seated an open inlet duct 46, and in the rounded lower end wall is an open outlet slot 48. Flowing in a direction depicted by the arrows shown in FIG. 3, a stream of air blown by blower 49 enters into air plenum 44 through open inlet duct 46, and then flows through baffle 50 that disperses the stream of air so it is more evenly distributed as it flows toward and through open outlet slot 48.

Air plenum 44 is oriented along a parallel plane lying in a proximate position above trajectory 26 so that air expelled through open outlet slot 48 flows along the lower outer surface 43 of housing 42 in a direction that opposes the flow of articles 14 moving along trajectory 26, as depicted by the relevant arrows. The opposing flow of the stream of air beneath lower outer surface 43 of housing 42 decelerates the velocity of articles 14 in trajectory 26. This slowdown cushions the impact when articles 14 come into contact with conveyor 54 immediately following their deceleration and thereby abates damage to articles 14.

Figure 3:
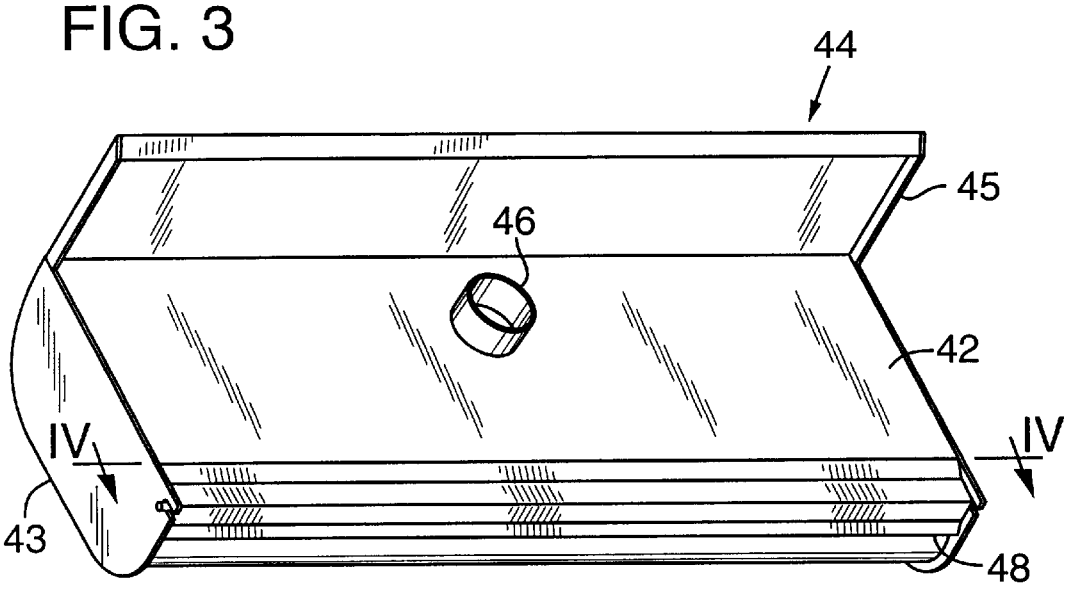
FIG. 3 is an isometric perspective view of a preferred embodiment of the present invention.

FIG. 3 is an isometric illustration of a preferred embodiment of the present invention. As shown, housing 42 has a generally rectangular upper portion and an arcuate lower outer surface 43. The lower outer surface 43 of housing 42 curves inwardly to form a shallow concave surface. The outer surface of a rounded rear wall extending from open outlet slot 48 to lower outer surface 43 at the downstream end of air plenum 44 entrains the stream of air against the adjacent curve in the lower outer surface 43 of housing 42, generating a laminar flow of the stream of air in a direction that opposes articles 14 in trajectory 26. Thus cushioned by this airflow, articles 14 are slowed to a low velocity in a short time, and settle onto conveyor 54, i.e., the second surface area.

Air flowing along lower outer surface 43 escapes upwardly past a substantially linear front wall 45 that is oriented at an angle of about 90 degrees from the horizontal plane. Front wall 45 extends upwardly beyond the upper surface of housing 42 into a planar wall for directing the stream of air in an upward direction. In the illustrated embodiment, the gap between the perpendicular wall of housing 42 and the closest component of the inspection and sorting system ejection module 30, is about 15 inches [38.1 cm]. In alternative orientations of air decelerator, this gap width may vary substantially.

In the illustrated embodiment, the lower outer surface 43 of housing 42 extends about two inches beyond each side of conveyor 54. A lower surface width that at least coextends with the entire belt width enhances dispersion of the stream of air through all paths through which articles 14 may move. Belt widths may measure between 24 inches [60.96 cm] and 72 inches [182.88 cm], or more or less. However, an outer surface that does not extend to the width of a receiving belt or chute could be employed to effect deceleration of at least some of articles 14 in trajectory 26.

The housing shown in FIG. 3 has a width of about 52 inches [132.08 cm], a length of about 4 inches [10.16 cm], and a depth of about 12 inches [30.48 cm]. Air plenum 44 is installed on mounting brackets attached by bolts to frame members (not shown) of automatic inspection and sorting system 10, in a manner well known by persons of ordinary skill in the art. The embodiment shown is installed so the lower outer surface 43 is tilted at a slight downward angle of between about 25 degrees and about 35 degrees from the horizontal plane. The angle of housing 42 and airflow velocity blown from blower 43 may be adjusted to provide desired product placement on the second area surface. Damper 51 may further be adjusted to generate a suitable static pressure. Satisfactory adjustments project an airflow velocity causing articles 14 in trajectory 26 to occasionally "graze" the bottom surface 43 of housing 42.

Open outlet slot 48 is formed by a gap between two formed pieces of sheet metal measuring about 0.25 inches [10.64 cm] in width extending across the entire width of housing 42. According to this embodiment, open outlet slot 48 is defined by a stepped up upper lip forming a "slit" which projects over a lower lip to direct the stream of air moving through the open outlet slot 48 downwardly toward the portion of trajectory 26 below it. The air from open outlet slot 48 is directed tangent to the curve of lower end. Low pressure generated along the inward curve of outer lower surface 43 by the moving air causes the stream of air to bend and thereby essentially remain tangent to this curve bringing it in opposition to trajectory 26. In alternative embodiments, the particular configuration of open outlet slot 48 can vary. For example, it could consist of a single rounded or angular aperture, or of successive rounded or angular perforations, of varying shapes and dimensions.

Blower 49 and damper 51 are installed on the inspection and sorting system 10, and adjusted to blow air at suitable pressure and velocity rate into open inlet duct 46. Adjustments of blower 49 and damper 51 to generate suitable velocity rates will vary with component dimensions, and the volume and density of the articles sorted. As shown in the drawings, damper 51 may be adjusted to produce an airflow providing a velocity at the slot of between about 2,800 feet/minute and about 4,900 feet/minute and a static pressure within the plenum of between about 0.50 inch and about 1.50 inch w.c. In alternative applications, appropriate adjustments can be made for desired deceleration and cushioning of other fragile articles, such as cereals, chips processed from other fruits and vegetables, and similar crunchy but fragile snack foods.

The dimensions, configuration, and mounting of air plenum 44 may be adjusted to provide appropriate airflow for decelerating various articles in accordance with their size, density and configuration. In addition to suitable dimensions and spatial arrangements of air plenum 44 and its components, appropriate adjustment of blower 49 and damper 51 is requisite to providing an acceptable air velocity.

Figure 4:
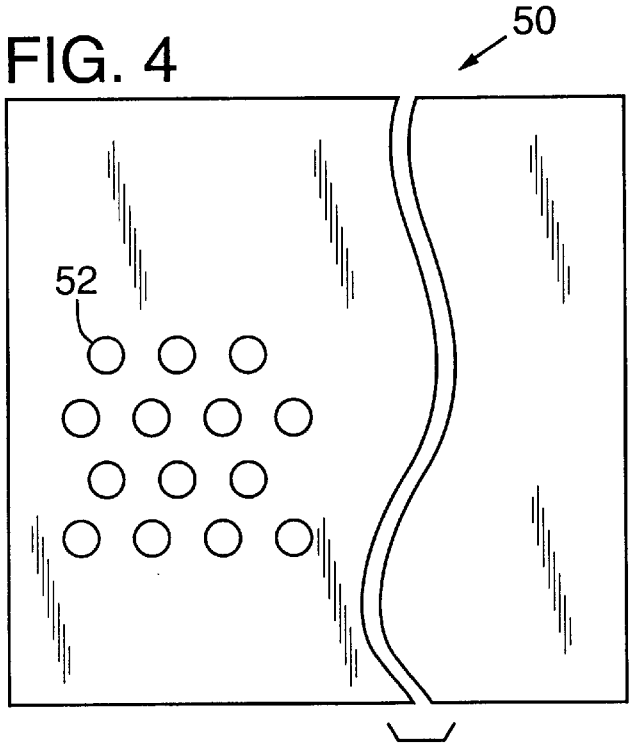
FIG. 4 is a cross-section view of the preferred embodiment taken along lines IV—IV as shown in FIG. 3.

As shown, FIG. 4 is a cross-section taken along the plane in which baffle 50 is mounted. Baffle 50 has circular perforations 52 through which a stream of air is blown to more evenly disperse air moving through open outlet slot 48. In the illustrated embodiment, perforations 52 are circular, measuring about 0.25 inches [0.64 cm] in diameter, and cover the entire baffle 50. Baffle 50 shown is mounted on the wall of housing 42 in an orientation that is parallel to the edge of open outlet slot 48. Alternative embodiments of the present invention may include baffles with perforations of varying sizes and shapes, and may not include a baffle at all.

It will be obvious to those having skill in the art that many changes may be made to the details of the above-described embodiment of this invention without departing from the underlying principles thereof. The scope of the present invention should, therefore, be determined only by the following claims.

I claim:

1. In a system for sorting unacceptable and acceptable articles according to predetermined characteristics, wherein the articles are conveyed past a video scanning camera that sends video data to a video signal processor for actuating selected combinations of multiple ejection modules to deflect unacceptable articles with an ejection gas toward a first trajectory directed to a first area surface and to permit articles that are not deflected by an ejection gas to proceed in a second trajectory directed to a second area surface, an air decelerator adapted to generally cause a stream of air directed through an air plenum to flow in a direction opposing articles in the second trajectory and thereby decelerate the velocity of the articles to reduce the impact of the articles when the articles come into contract with the second area surface, the air decelerator comprising: a housing defining an air plenum having outer surfaces enclosing a generally hollow interior, wherein a lower outer surface of the housing facing downwardly toward the second trajectory is oriented at a slight declining slope in a proximate position above and substantially parallel to the second trajectory, and wherein an upper surface of the housing has an open inlet through which the stream of air enters into the housing and an open outlet through which the stream of air flows out of the housing in a direction along the lower outer surface of the housing so as to oppose articles in the second trajectory and thereby decelerate the velocity of the articles to reduce impact forces imposed on the articles when the articles come into contact with the second area surface.

2. The system of claim 1, wherein the lower outer surface is curved inwardly toward a center area of the lower outer surface to form a shallow concavity.

3. The system of claim 2, wherein the second area surface comprises a section of a conveyor and the lower outer surface of the housing has a width that at least coextends with the width of the conveyor.

4. The system of claim 2, wherein the housing has a generally linear front wall proximate to the ejection module, the front wall being radially joined to the lower outer surface to form an angle of less than about 120 degrees from a horizontal plane, the front wall extending upwardly beyond the upper surface of the housing to form a planar wall permitting the stream of air below the lower outer surface to escape in an upward direction.

5. The system of claim 4, wherein the generally linear front wall is radially joined to the lower outer surface to form a substantially perpendicular angle with a horizontal plane.

6. The system of claim 4, wherein the lower outer surface is radially joined to a generally rounded rear wall.

7. The system of claim 6, wherein the open outlet comprises a slot in the rear wall of the housing, the slot being substantially perpendicular to the longitudinal axis of the second trajectory.

8. The system of claim 7, wherein the slot extends across the width of the rear wall of the housing.

9. The system of claim 7, wherein the slot extends across the width of the rear wall of the housing, the slot being defined by an upper edge periphery stepped up from the lower edge facing the slot downwardly toward the portion of the second trajectory directly below the slot.

10. The system of claim 9, wherein the housing of the air plenum is oriented to place the lower outer surface of the housing in a slight declining slope in a proximate position above and substantially parallel to the second trajectory, wherein the slope declines at an angle of between about 25 degrees and about 35 degrees from the horizontal plane.

11. The system of claim 4, wherein the air plenum is oriented to leave a gap measuring at least 15 inches between the housing and the ejection modules to permit an upward escape of air accumulated below the outer lower surface of the housing.

12. The system of claim 4, further comprising a baffle plate mounted to an inner surface within the generally hollow interior of the housing substantially parallel to the slot axis within the housing, the baffle plate containing multiple perforations to disperse air directed toward the open outlet.

13. The system of claim 12, wherein the stream of air passing through the slot has a velocity of between about 2,800 feet/minute and about 4,900 feet/minute.

14. The system of claim 12, wherein the stream of air passing through the slot has a static pressure of between about 0.50 inch and about 1.5 inch w.c.

15. The system of claim 1, further comprising a generally circumferential inlet duct adapted to fit within the open inlet such that the stream of air entering the duct flows in a generally downward direction.

16. The system of claim 1, further comprising a blower adapted to generate a stream of air at least some of which is directed toward the open inlet of the housing.

17. The system of claim 1, further comprising a means for blowing a stream of air at least some of which is directed toward the open inlet of the housing at a static pressure resulting in an aerodynamic drag causing deceleration of the articles in the second trajectory when being opposed by air in the stream to an extent that permits the articles to drop in the second area surface.

18. The system of claim 1, further comprising a means for blowing a stream of air at least some of which is directed toward the open inlet of the housing, and a means for dampening the stream of air to generate a static pressure resulting in an aerodynamic drag causing deceleration of the articles in the second trajectory when being opposed by air in the stream to an extent that permits the articles to drop in the second area surface.

19. In a sorting system in which acceptable and unacceptable articles are conveyed past a video scanning camera that sends video data to a video signal processor for actuating selected combinations of multiple air ejection modules to deflect with ejection air unacceptable articles toward a first trajectory directed to a first area surface and acceptable articles proceed in a second trajectory directed to a second area surface, a method of decelerating the velocity of the articles directed toward the second trajectory, comprising the steps of:

providing a housing defining an air plenum having outer surfaces enclosing a generally hollow interior, the housing having an open inlet and an open outlet;

positioning the housing so that-a lower outer surface of the housing is oriented to place the housing axis lying perpendicular to the slot in a slight downward slope in a proximate position above and substantially parallel to the second trajectory; and blowing a stream of air into the open inlet of the housing such that at least a portion of the stream of air is blown out of the open outlet in a direction that flows along the lower outer surface of the housing and thereby opposes the articles in the second trajectory to thereby decelerate the velocity of the articles and thus reduce impact forces imposed on the articles when the articles come into contact with the second area surface.

20. The method of claim 19, wherein the lower outer surface of the housing is curved inwardly toward a center area of the lower outer surface to form a shallow concavity.

21. The method of claim 19, wherein the second area surface comprises a section of a conveyor belt, and wherein the lower outer surface of the housing has a width that at least coextends with the width of the conveyor belt.

22. The method of claim 19, further comprising the step of blowing the stream of air in a generally downward direction into a circumferential inlet duct adapted to fit within the open inlet.

23. The method of claim 19, further comprising the step of dampening the stream of air to generate a velocity rate resulting in a static pressure decelerating the articles in the second trajectory to an extent that permits the latter articles to drop in the second area surface when opposed by air in the stream.

24. The method of claim 19, wherein the housing provided comprises a generally linear front wall proximate to the ejection module, the forward wall being integrally joined to the outer lower surface at a periphery nearest the ejection module to form an angle of less than about 120 degrees from the horizontal plane, the front wall extending upwardly beyond the upper surface of the housing into a planar wall for directing the stream of air in an upward direction and a generally rounded rear end wall radially integrated with the outer lower surface, and wherein the open outlet comprises a transverse slot in the rear wall of the housing.

25. The method of claim 24, wherein the generally linear front wall is integrally joined to the outer lower surface to form a substantially perpendicular angle with a horizontal plane.

26. The method of claim 19, further comprising the step of permitting air accumulated below the lower outer surface of the housing to escape in an upward direction.

27. The method of claim 26, further comprising the step of dispersing the stream of air in the housing directed with a perforated baffle plate to optimize the stream of air velocity that flows through the open outlet.

28. The method of claim 19, wherein the stream of air is blown into the open inlet of the air plenum by a blower.

29. The method of claim 28, wherein the blower generates a velocity rate such that the stream of air passing through the slot has a velocity of between about 2,800 feet/minute and about 4,900 feet/minute.

30. The method of claim 28, wherein the blower generates an airflow pressure such that the stream of air passing through the slot has a static pressure of between about 0.50 inch and about 1.5 inch w.c.

31. The method of claim 19, further comprising orienting the air plenum to place the lower outer surface of the housing in a slight declining slope in a proximate position above and substantially parallel to the second trajectory, wherein the slope declines at an angle of between about 25 degrees and about 35 degrees from the horizontal plane.

* * * * *